United States Patent [19]

Ohnishi et al.

[11] Patent Number: 4,951,874

[45] Date of Patent: Aug. 28, 1990

[54] UNIT FUEL INJECTOR

[75] Inventors: Masanori Ohnishi; Toshiaki Kasahara; Kouichi Saga; Xin-he Li, all of Higashimatsuyama, Japan

[73] Assignee: Diesel Kiki Co., Ltd., Tokyo, Japan

[21] Appl. No.: 390,893

[22] Filed: Aug. 8, 1989

[30] Foreign Application Priority Data

Sep. 1, 1988 [JP] Japan ..... 63-114008[U]
Oct. 31, 1988 [JP] Japan ..... 63-275248

[51] Int. Cl.[5] ..... F02M 47/00

[52] U.S. Cl. ..... 239/88; 239/124; 239/585

[58] Field of Search ..... 239/88, 89, 90, 91, 239/93, 95, 124, 585

[56] References Cited

U.S. PATENT DOCUMENTS

| | | | |
|---|---|---|---|
| 4,392,612 | 7/1983 | Deckard et al. | 239/88 |
| 4,408,718 | 10/1983 | Wich | 239/88 |
| 4,418,867 | 12/1983 | Sisson | 239/88 |
| 4,463,900 | 8/1984 | Wich | 239/88 |
| 4,470,545 | 9/1984 | Deckard et al. | 239/88 |
| 4,485,969 | 12/1984 | Deckard et al. | 239/88 |
| 4,494,696 | 1/1985 | Schneider | 239/90 |
| 4,527,737 | 7/1985 | Deckard | 239/89 |
| 4,572,433 | 2/1986 | Deckard | 239/88 |
| 4,618,095 | 10/1986 | Spoolstra | 239/90 |
| 4,674,461 | 6/1987 | Hiyama et al. | 239/95 |

FOREIGN PATENT DOCUMENTS 63-73570 5/1988 Japan .

*Primary Examiner*—Andres Kashnikow
*Assistant Examiner*—Michael J. Forman

[57] ABSTRACT

A unit fuel injector includes a body, the body having a fuel supply and return chamber, a fuel supply passage communicating with the chamber, and a drain passage communicating with the chamber. The body is provided with a pump mechanism, an injection nozzle mechanism for injecting high pressure fuel from the pump mechanism, and an electromagnetic valve mechanism for escaping the high fuel pressure from the pump mechanism. The electromagnetic valve mechanism include a poppet-type valve member. Immediately when a head of the valve member is disengaged from a valve seat facing the fuel supply and return chamber, the pressurized fuel within the pump mechanism is spilled or fed to the fuel supply and return chamber. The unit fuel injector further includes an auxiliary valve mechanism for opening and closing the drain passage. The auxiliary valve mechanism includes a valve port at one end of the drain passage, and when the head of the valve member abuts against a stop portion of the body, the valve port is closed.

6 Claims, 5 Drawing Sheets

UNIT FUEL INJECTOR

BACKGROUND OF THE INVENTION

1. Field of the Invention

This invention relates to a unit fuel injector for use in an internal combustion engine such as a diesel engine.

2. Prior Art

A unit fuel injector comprises a pump mechanism and an injection nozzle mechanism both of which are incorporated in an injector body, the unit fuel injector being mounted on an engine. The pump mechanism includes a cylinder bore formed in the body, and a plunger received in the cylinder bore for reciprocal movement therealong. A pump chamber is defined by the cylinder bore and the plunger. The volume of the pump chamber is reduced during an advance or pump stroke of the plunger, and is increased during a return or suction stroke of the plunger. The injection nozzle mechanism includes an injection port in communication with the pump chamber, and a valve disposed between the pump and the injection port. When the pressure of fuel within the pump chamber is increased to a high level during the pump stroke of the plunger, the valve is opened to inject the fuel from the injection port. The unit fuel injector is also provided with a fuel relief control mechanism by which the relief of the fuel pressure within the pump chamber is controlled during the pump stroke of the plunger so as to control the timing of starting the fuel injection and the timing of terminating the fuel injection. As one example of such fuel relief control mechanism, an electromagnetic valve mechanism has been proposed.

U.S. Pat. No. 4,674,461 discloses a unit fuel injector provided with such an electromagnetic valve mechanism. More specifically, there is provided a relief passage communicating at one end with a pump chamber, the other end of the relief passage being opened and closed by a needle-type valve member of an electromagnetic valve. In this conventional unit fuel injector, during the time when the fuel injection is being effected, with the relief passage closed, the valve member is subjected to a very high fuel pressure. Therefore, to cope with such a high fuel pressure, an associated solenoid is required to produce a sufficiently great force for holding the valve member in its closing position.

U.S. Pat. Nos. 4,392,612, 4,470,545, 4,485,969 and 4,527,737 also describe unit fuel injectors incorporating an electromagnetic valve mechanism. More specifically, such a fuel injector comprises a body which has a fuel supply and return chamber, a fuel supply passage and a drain passage, the fuel supply passage and the drain passage both communicating with the fuel supply and return chamber. The fuel supply passage is connected to a fuel tank via an external fuel pump, and the drain passage is connected to the fuel tank. The electromagnetic valve mechanism has a guide hole formed in the body, and a poppet-type valve member guided in the guide hole. The guide hole communicates at one end with the fuel supply and return chamber, and a valve seat is formed on the one end surface of the guide hole. The valve member includes a stem portion, and a head formed at one end of the stem portion. This stem portion has a reduced diameter portion disposed adjacent to the head. The stem portion is slidably received in the guide hole, and an annular space is formed between the reduced diameter portion and the inner peripheral surface of the guide hole. This annular space is in communication with a pump chamber. The electromagnetic valve mechanism also includes a stop portion facing the fuel supply and return chamber in opposed relation to the valve seat. The head of the valve member is disposed within the fuel supply and return chamber, and is movable between the stop portion and the valve seat. The electromagnetic valve further comprises an armature connected to the other end of the stem portion of the valve member, and a solenoid drive means for driving the armature. The solenoid drive means comprises a solenoid for urging the armature in such a manner that the valve member can be moved toward the valve seat, and a spring for urging the valve member in a direction away from the valve seat. The armature is received within an armature chamber formed in either the body or a casing fixedly mounted on the body.

In the above conventional unit fuel injector, during the suction stroke of the plunger, the solenoid is in its de-energized condition, so that the valve member is spaced apart from the valve seat. In this condition, the fuel is supplied from the external fuel pump to the pump chamber via the fuel supply passage, the fuel supply and return chamber and the annular space. When the solenoid is energized during the pump stroke of the plunger, the valve member is brought into engagement with the valve seat, so that the communication of the fuel supply and return chamber with the pump chamber is interrupted. As a result, the fuel within the pump chamber is pressurized and is injected from an injection nozzle mechanism. At this time, the fuel pressure is applied to the opposed shoulders formed respectively on the opposite ends of the reduced diameter portion of the valve member, so that the forces acting respectively on these opposed shoulders cancel each other. Therefore, the force required to be produced by the solenoid so as to hold the valve member in its closed position can be relatively small. When the solenoid is deenergized during the pump stroke of the plunger, the valve member is brought out of engagement with the valve seat under the influence of the spring, so that the fuel of high pressure within the pump chamber is spilled to the fuel supply and return chamber. As a result, the pressure within the pump chamber decreases, thus terminating the fuel injection operation.

At the moment when the valve member is disengaged from the valve seat so as to terminate the fuel injection operation as described above, the pressure within the fuel supply and return chamber becomes high, and the valve member is urged by this high pressure toward the valve seat. As a result, the speed of disengagement of the valve member from the valve seat under the influence of the spring may become slower, or the valve member may be instantaneously moved back toward the valve seat. This results in a problem that the area of flow between the valve seat and the valve member can not be increased quickly, so that the pressure drop in the pump chamber is retarded. As a result, the fuel injection operation fails to be completely terminated at a time, and the problem of subsequent dripping of the fuel is encountered.

In order to overcome this problem, the above-mentioned U. S. patents have proposed the following procedure. Specifically, the fuel supply and return chamber is communicated with the armature chamber by a passage, formed in the valve member, and/or a passage formed in the body. With this arrangement, the pressure of the above-mentioned spill fuel is applied not only to the fuel supply and return chamber but also to the armature chamber, so that substantially the same pressure acts on both of the opposite ends of the valve member, thereby canceling the forces acting on the valve member in opposite axial directions of the valve member.

With the electromagnetic valve mechanism of the above-mentioned U.S. patents, however, the fuel is filled in the armature chamber, and therefore the speed of movement of the armature is limited by the flow resistance of the fuel. As a result, the speed of movement of the valve member in response to the energization and de-energization of the solenoid becomes slow. Therefore, the speed of movement of the valve member in its opening direction becomes slow, which results in a risk that the valve member may fail to terminate the fuel injection operation at a time. Since the speed of movement of the valve member in its closing direction also becomes slow, the pressure within the pump chamber can not be increased at a proper speed.

In the fuel injectors of the above-mentioned U.S. patents, since the fuel supply and return chamber communicates with the fuel tank via the drain passage, there is a possibility that the above-mentioned spill fuel may escape to the drain passage. However, because of the provision of orifices in a drain pipe connected between the drain passage and the tank, such spill fuel pressure relief is quite insufficient. Incidentally, these orifices are required for the following reason. During the time when the fuel is supplied from the external fuel pump to the pump chamber via the fuel supply and return chamber, with the valve member disengaged from the valve seat, the escape of the fuel pressure from the fuel supply and return chamber is prevented because of the orifices, formed in the drain pipe, thereby maintaining the fuel supply pressure to the pump chamber at a predetermined level. In this connection, see column 7, lines 29 to 43 of the above-mentioned U.S. Pat. No. 4,392,612.

The above-described problems are also encountered in fuel injectors disclosed in U.S. Pat. Nos. 4,463,900 and 4,618,095 and similar in construction to the fuel injectors of the above-mentioned U.S. patents.

Japanese Laid-Open Utility Model Application No. 73570/88 discloses a unit fuel injector comprising an electromagnetic valve mechanism. The electromagnetic valve mechanism includes an armature chamber which at a glance, seems not to be filled with fuel. However, in this prior art publication, there is no clear description of a mechanism for relieving a spill fuel pressure.

SUMMARY OF THE INVENTION

It is therefore an object of this invention to provide a unit fuel injector in which a fuel supply pressure to a pump chamber can be maintained at a predetermined level without providing any orifice in a discharge system connected to a drain passage, and upon termination of a fuel injection operation, the pressure of fuel spilled into a fuel supply and return chamber can be relieved through the drain passage.

According to the present invention, there is provide a unit fuel injector comprises:

(a) a body having a fuel supply and return chamber, a fuel supply passage means connected to the fuel supply and return chamber so as to supply fuel to the chamber, and a drain passage means connected to the fuel supply and return chamber;

(b) pump means mounted on the body and including a cylinder hole formed in the body, and a plunger received in the cylinder hole so as to be reciprocally movable along the cylinder hole to achieve a pump stroke and a suction stroke, a pump chamber being defined by the cylinder hole and the plunger, and the pump chamber being connected to the fuel supply and return chamber;

(c) nozzle means mounted on the body and including an injection port connected to the pump chamber, and an injection valve for controlling the communication between the injection port and the pump chamber, the injection valve being opened upon increase of the pressure within the pump chamber to a predetermined level;

(d) electromagnetic valve means including a guide hole formed in the body and a valve member guided in the guide hole, the guide hole communicating at one end with the fuel supply and return chamber, a valve seat being formed on a surface defining the one end of the guide hole, the valve member having a stem portion and a head formed at one end of the stem portion, the stem having a reduced diameter portion disposed adjacent to the head, the stem portion being slidably received in the guide hole, an annular space being formed between the reduced diameter portion and an inner peripheral surface of the guide hole, the annular space being in communication with the pump chamber, the electromagnetic valve means further including a stop portion facing the fuel supply and return chamber in opposed relation to the valve seat, the head of the valve member being disposed in the fuel supply and return chamber, the valve member being movable between a first position where the head is held against the stop portion and away from the valve seat to communicate the fuel supply and return chamber with the pump chamber via the annular space and a second position where the head is held away from the stop portion and against the valve seat to interrupt the communication between the pump chamber and the fuel supply and return chamber, the electromagnetic valve member further including an armature connected to the other end of the stem portion, a solenoid drive means for driving the armature so as to move the valve member, the valve member being disposed in the first position during the suction stroke so that the fuel is supplied to the pump chamber from the fuel supply and return chamber; when the valve member is moved from the first position to the second position during the pump stroke, the fuel pressure within the pump chamber being increased to thereby start the injection of the fuel from the injection port; and when the valve member is moved from the second position to the first position during the pump stroke, the fuel of high pressure within the pump chamber being spilled to the fuel supply and return chamber to thereby terminate the fuel injection; and (e) auxiliary valve means for opening and closing the drain passage means, the auxiliary valve means comprising the head of the valve member, the stop portion and a valve port provided at one end of the drain passage means, the valve port being closed when the valve member in the first position.

DESCRIPTION OF THE PREFERRED EMBODIMENTS OF THE INVENTION

Figure 2:
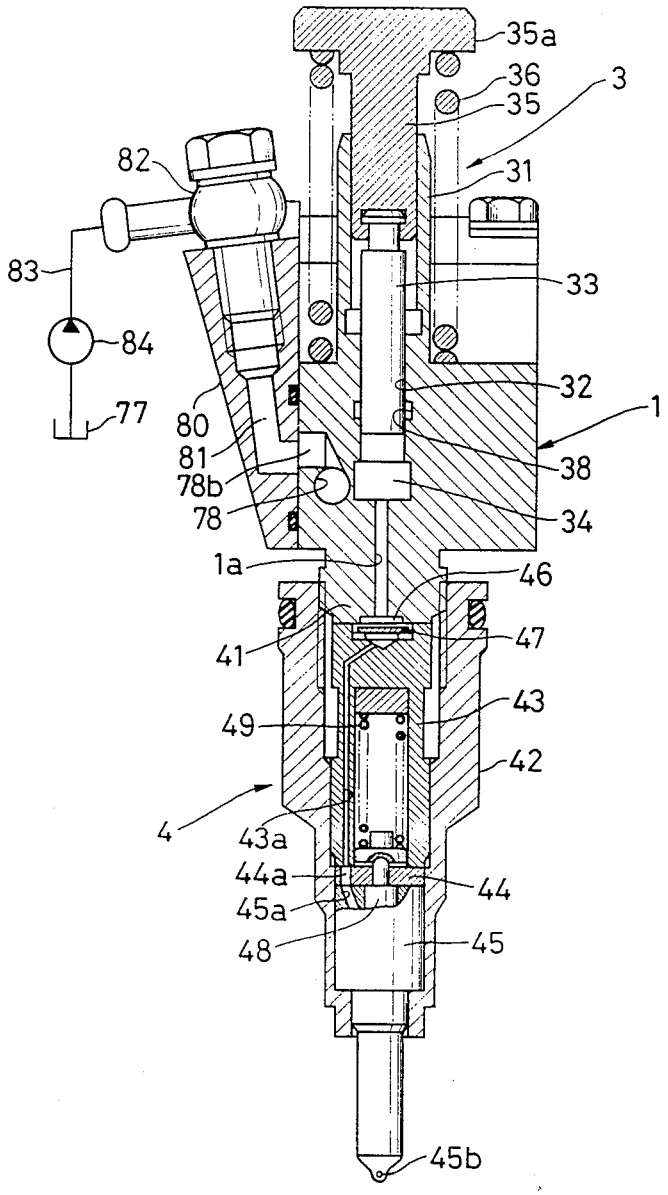
FIG. 2 is a cross-sectional view taken along the line II—II of FIG. 1.
Figure 3:
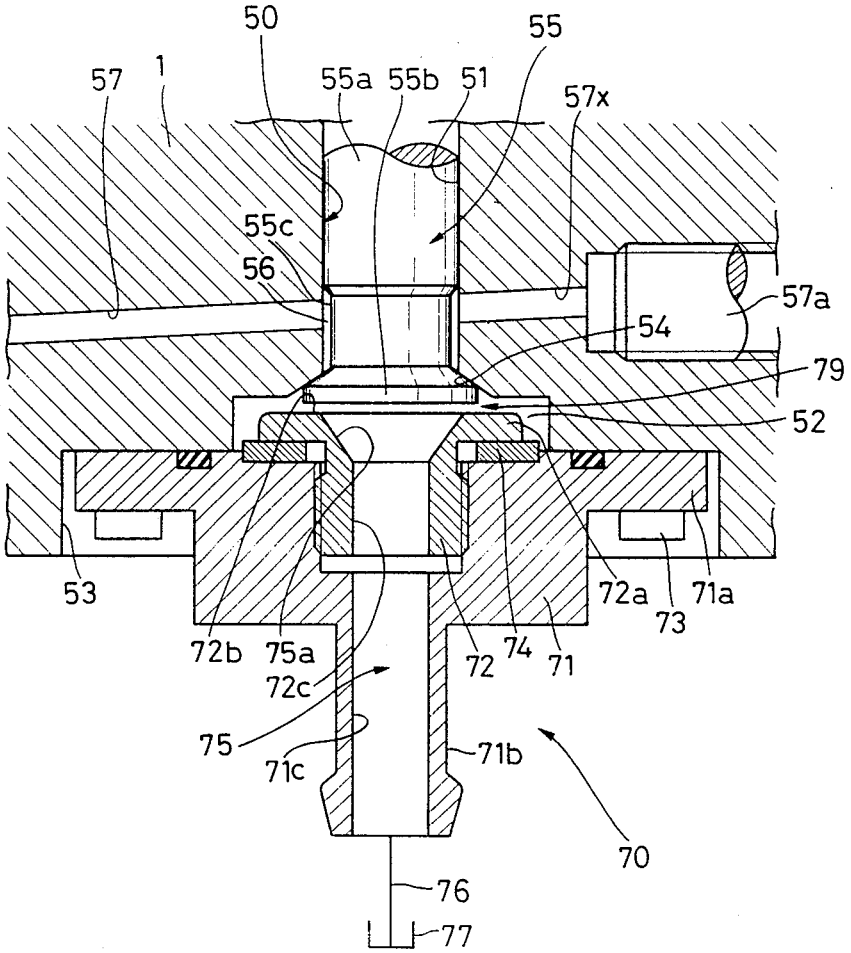
FIG. 3 is an enlarged cross-sectional view of an important portion of the fuel injection.

A preferred embodiment of the prevent invention will now be described with reference to FIGS. 1 to 3.

A unit fuel injector shown in these Figures comprises a horizontally extending body 1. The body 1 incorporates a pump mechanism 3 for pressurizing fuel, an injection nozzle mechanism 4 for injecting the thus pressurized fuel into a cylinder of an engine, and an electromagnetic valve mechanism 5 for controlling the timing of starting the fuel injection and the timing of terminating the fuel injection. The pump mechanism 3 and the injection nozzle 4 are both provided at the left-hand portion of the body 1 (FIG. 1) whereas the electromagnetic valve mechanism 5 is provided at the righthand portion of the body 1.

First, the pump mechanism 3 will now be described in detail. The body 1 has a tubular portion 31 extending vertically upwardly from the upper side of the body 1, and a cylinder hole 32 is formed in the body 1 in coaxial relation to the tubular portion 31. The diameter of the cylinder hole 32 is smaller than the inner diameter of the tubular portion 31, and the cylinder hole 32 is enlarged in diameter at its lower end. A plunger 33 is received in the cylinder hole 32 so as to be reciprocally movable therealong, the plunger 33 extending into the tubular portion 31. The lower end face of the plunger 33 defines, together with the cylinder hole 32, a pump chamber 34. As the plunger 33 is moved downward (an advance or pump stroke), the volume of the pump chamber 34 is reduced so as to pressurize the fuel in the pump chamber 34. As the plunger 33 is moved upward (a return or suction stroke), the volume of the pump chamber 34 is increased so as to introduce the fuel into the pump chamber 34 by suction.

A follower member 35 is received in the tubular portion 31 for sliding movement therealong. The lower end of the follower member 35 is connected to the upper end of the plunger 33. The follower member 35 has at its upper end an enlarged diameter portion 35*a*. The follower member 35 is urged upward by a coil spring 36 acting between the enlarged diameter portion 35*a* and the upper surface of the body 1, so that the follower member 35 is always held in contact with a cam portion of a cam shaft rotated by an engine (not shown). In response to the rotation of the cam shaft, the follower member 35 is moved upward and downward together with the plunger 33. A limit member 37 is secured to the follower member 35 and is slidably received in a vertical slot 31*a* formed through the tubular portion 31. The limit member 37 is brought into engagement with the upper end of the slot 31*a* to limit the upward movement of the follower member 35 and hence to prevent the follower member 35 from becoming disengaged upwardly from the tubular portion 31.

A leakage prevention groove 38 of an annular shape is formed in the central portion of the inner peripheral surface of the cylinder hole 32, and serves to prevent the fuel, contained in the pump chamber 34, from leaking to the exterior through a gap between the inner peripheral surface of the cylinder hole 32 and the outer peripheral surface of the plunger 33.

Next, the injection nozzle mechanism 4 will now be described in detail. A projection 41 extends vertically downwardly from the lower surface of the body 1 in coaxial relation to the tubular portion 31. A tubular retainer 42 is threadedly connected at its upper end to the projection 41. In downward sequence, a spring holder 43, a spacer 44 and an injection nozzle 45 are mounted in the retainer 42. The projection 41, the spring holder 43, the spacer 44 and the injection nozzle 45 are held in intimate contact with one another by threadedly tightening the retainer 42 relative to the projection 41. The retainer 42 is received in a hole formed in a cylinder head of the engine, and the distal or lower end of the injection nozzle 45 faces the cylinder of the engine.

The injection nozzle 45 has at its distal end injection ports 45*b*. As best shown in FIG. 2, the injection portion 45*b* is in communication with the pump chamber 34 via a passage 45*a* in the injection nozzle 45, a passage 44*a* in the spacer 44, a passage 43*a* in the spring holder 43 and a passage 1*a* in the body 1.

A valve receiving chamber 46 is formed in the mated surfaces of the projection 41 and spring holder 43, and a disc-shaped check valve 47 is received within the valve receiving chamber 46 and serves to prevent the flow of the fuel from the passage 45*a*, formed in the injection nozzle 45, to the pump chamber 34.

A needle valve 48 is slidably received in the injection nozzle 45. The needle valve 48 is urged downwardly by a coil spring 49, mounted within the spring holder 43, so as to close the injection port 45*b*. The needle valve 48 has a pressure receiving portion (not shown) intermediate opposite ends thereof. This pressure receiving portion disposed in an oil reservoir chamber (not shown) provided at a mid portion of the passage 45*a* in the injection nozzle 45. The needle valve 48 receives the fuel pressure from the pump chamber 34 through this pressure receiving portion, and when this fuel pressure exceeds a set pressure determined by the spring 49, the needle valve 48 rises or lift against the bias of the spring 49, thereby opening the injection ports 45*b* to inject the fuel of high pressure.

Figure 1:
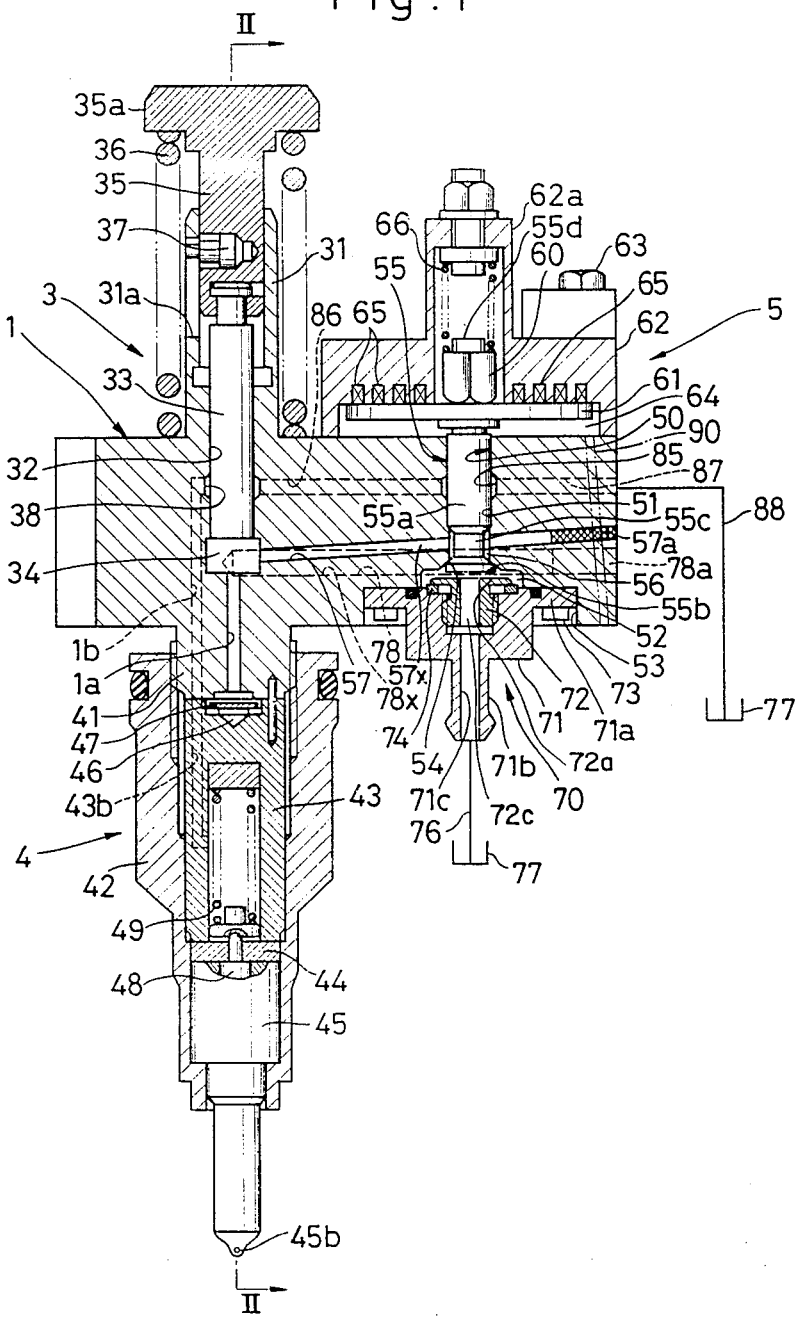
FIG. 1 is a vertical cross-sectional view of a unit fuel injector provided in accordance with the present invention.

As shown in FIG. 1, the internal space or interior of the spring holder 43 is in communication with the leak prevention groove 38 through a passage 43*b* in the spring holder 43 and a passage 1*b* in the body 1. With this arrangement, the fuel, leaking from the oil reservoir chamber of the injection nozzle 45 into the spring holder 43 through a small gap between the inner peripheral surface of the injection nozzle 45 and the outer peripheral surface of the needle valve 48, is fed to the leakage prevention groove 38 through the passages 43*b* and 1*b*.

Next, the electromagnetic valve mechanism 5 and its associated parts will now be described in detail. As shown in FIGS. 1 and 3, a stepped bore 50 is formed through the body 1 and extends vertically from the upper surface to the lower surface of the body 1. The stepped bore 50 has an upper portion, an intermediate portion greater in diameter than the upper portion, and a lower portion greater in diameter than the intermediate portion. More specifically, the upper portion of the stepped bore 50 serves as a guide hole 51 for guiding the movement of a valve member 55 (later described), and the intermediate portion serves as a fuel supply and return chamber 52, and the lower portion serves as a mounting bore 53 for receiving a lid assembly (closure means) 70 later described.

That portion of the inner peripheral surface of the guide hole 51, which defines the lower end of the guide hole 51 and is disposed immediately adjacent to the fuel supply and return chamber 52, serves as a valve seat 54 of a tapered shape which increases in diameter progressively toward its lower end.

The valve member 55 guided in the guide hole 51 has a stem portion 55*a*, and a head 55*b* which is formed at the lower end of the stem portion 55*a* and is greater in diameter than the stem portion 55*a*. The stem portion 55*a* has a reduced diameter portion 55*c* disposed adjacent to the head 55*b*. The head 55*b* of the valve member 55 disposed in the fuel supply and return chamber 52 has a tapered section which is moved into and out of sealing contact of the valve seat 54. An annular space 56 is formed between the outer peripheral surface of the reduced diameter portion 55*c* and the inner peripheral surface of the guide hole 51. The annular space 56 is in communication with the pump chamber 34 through a passage 57 formed in the body 1. The passage 57 is formed by a bore 57*x* formed in the body 1 and extending from one end of the body 1 to the pump chamber 34, and a closure member 57*a* is fitted in and closes one end of the bore 57*x* which opens to the one end of body 1.

The upper end portion of the valve member 55 projects upwardly beyond the upper surface of the body 1, and has external threads to provide a threaded portion 55*d* on which a disc-shaped armature 61 is mounted by a nut 60 threadedly engaging the threaded portion 55*d*. A casing 62, having an opening at its lower surface, is fixedly secured to the upper surface of the body 1 by a bolt 63. This opening closed by the upper surface of the body 1 serves as an armature chamber 64 within which the armature 61 is disposed. Solenoid coils 65 for attracting the armature 61 upwardly are embedded in the upper surface of the opening of the casing 62 facing the armature 61. The casing 62 has an upwardly extending tubular portion 62*a*. The internal space or interior of the tubular portion 62*a* is in communication with the armature chamber 64, and a coil spring 66 is mounted within this internal space so as to urge the armature 61 downwardly. The solenoid coils 65 and the spring 66 jointly constitute a solenoid drive means.

The timing of starting the energization of the solenoid coils 65 and the timing of termination this energization are controlled by means of a control portion (not shown), constituted, for example, by a microcomputer, in accordance with the operating conditions of the engine, such as the engine speed and the load.

The lid assembly 70, received in the mounting bore 53, constitutes part of the body 1, and comprises a lid 71, and a stop member 72 mounted on the lid 71. The lid 71 has a flange 71*a*, and is secured by screws 73 to the upper surface of the mounting bore 53. The lid 71 has a fitting portion 71*b* extending vertically downwardly from the lower surface thereof. The lid 71 has a stepped central bore 71*c* which extends vertically through the lid 71 and is defined by a bore (upper enlarged diameter portion) formed in the lid body and the bore (lower smaller diameter portion) of the fitting portion 71*b*, the stepped central bore 71*c* being disposed coaxially with the guide hole 51. The stop member 72 is threaded into the upper enlarged diameter portion of the stepped central bore 71*c*. The stop member 72 has at its upper end a flange 72*a*, and the upper surface of the flange 72*a* serves as a stop surface 72*b*. The stop surface 72*b* is flat and is disposed in opposed relation to the flat lower surface of the head 55*b* of the valve member 55. The head 55*b* of the valve member 55 is adapted to abut against the stop surface 72*b*, thereby limiting the downward movement of the valve member 55. An adjustment shim 74 is interposed between the flange 72*a* of the stop member 72 and the lid 71, and the adjustment shim 74 adjusts the amount of threading of the stop member 72 into the lid 71, and hence the amount of movement of the valve head 55*b* away from the valve seat 54.

The stop member 72 has an axial central bore 72*c* formed therethrough, and the central bore 72*c* and the lower portion of the stepped bore 71*c* of the lid 71 jointly constitute a drain passage 75. The upper end of the drain passage 75 (i.e., the tapered upper end of the central bore 72*c*) serves as a valve port 75*a*. The head 55*b* of the valve member 55, the stop member 72 and the valve port 75*a* jointly constitute an auxiliary valve mechanism 79. The diameter of the valve port 75*a* is smaller than the diameter of the lower end face of the head 55*b* of the valve member 55. Therefore, upon contact of the lower end face of the head 55*b* with the stop surface 72*b*, the valve port 75*a* is closed by the head 55*b*.

The fuel supply and return chamber 52 is in communication with a fuel tank 77 via the drain passage 75 and a drain pipe 76 connected to the fitting portion 71*b* of the lid 71. The drain pipe 76 is not provided with any orifice. The distal end of the drain pipe 76 is dipped in the fuel contained in the fuel tank 77.

The body 1 has a bore 78*x* extending generally horizontally from the one end of the body 1 toward the other end of the body 1 via the fuel supply and return chamber 52, the bore 78*x* serving as a fuel supply passage 78. A closure member 78*a* is fitted in and closes one end of the bore 78*x* which opens to the one end of the body 1. As shown in FIG. 2, the fuel supply passage 78 opens to the side of the body 1 through an auxiliary port 78*b* formed in the body 1. A block 80 is fixedly secured to the side of the body 1, the block 80 constituting part of the body 1. A fuel supply passage 81 is formed in the block 80, and communicates at one end with the auxiliary port 78*b* and also communicates at the other end with a fuel pump 84 via a fitting 82, connected to the block 80, and a fuel supply pipe 83 connected to the fitting 82. The fuel in the fuel tank 77 is supplied therefrom to the fuel injector under a pressure of about 5 to 6 $Kg/cm^2$.

As shown in FIG. 1, a leakage prevention groove 85 of an annular shape is formed in the mid portion of the inner peripheral surface of the guide hole 51. This leakage prevention groove 85 prevents the fuel within the fuel supply and return chamber 52 from leaking into the armature chamber 64 through a small gap between the inner peripheral surface of the guide hole 51 and the outer peripheral surface of the valve member 55. The leakage prevention groove 85 communicates with the above-mentioned leakage prevention groove 38 through a passage 86 formed in the body 1. A passage 87, formed in the body 1 in coaxial relation to the passage 86, communicates at one end with the leakage prevention groove 85 and opens at the other end to the one end of the body 1. The other end of the passage 87 is connected to the fuel tank 77 through a drain pipe 88.

In the construction illustrated, during the suction stroke of the plunger 33 of the pump mechanism 3, the volume of the pump chamber 34 is increased to draw the fuel thereinto by suction. During the suction stroke of the plunger 33, the solenoid coils 65 of the electromagnetic valve mechanism 5 are not energized, and therefore the valve member 55 is held, under the influence of the spring 66, in its lower position where the head **55*b* of the valve member 55 is spaced apart from the valve seat 54 and abuts at its lower surface against the stop surface 72*a* of the stop member 72**.

In this condition, the fuel from the fuel pump 84 flows into the fuel supply and return chamber 52 via the fuel supply passage 81 in the block 80 and the fuel supply passage 78 in the body 1, and the fuel thus fed to the fuel supply and return chamber 52 is further supplied to the pump chamber 34 via the space between the valve head **55*b* and the valve seat 54, the annular space 56 and the passage 57**.

During this fuel supply to the pump chamber 34, since the valve port **75*a*, formed in the stop surface 72*b* of the stop member 72, is closed by the head 55*b* of the valve member 55, the communication of the fuel supply and return chamber 52 with the drain passage 75 is interrupted. Therefore, the fuel pressure applied by the fuel pump 84 will not escape to the drain passage 75, so that the fuel supply to the pump chamber 34 can be carried out in a stable manner. Because of this, any orifice for restraining escape or relief of the above fuel supply pressure does not need to be provided in the drain pipe 76 connected to the drain passage 75**.

During the pump stroke of the plunger 33, the volume of the pump chamber 34 is reduced. At an initial stage of this pump stroke, the solenoid coils 65 are in their de-energized condition, and the fuel in the pump chamber 34 is returned to the fuel supply and return chamber 52 via the passage 57 and the annular space 56, and the fuel is further returned from the fuel supply and return chamber 52 toward the fuel pump 84.

During the pump stroke of the plunger 33, when the solenoid coils 65 are energized, the valve member 55 is moved upwardly against the bias of the spring 66, so that the tapered portion of the head **55*b* is brought into sealing engagement with the valve seat 54. As a result, the communication of the pump chamber 34 with the fuel supply and return chamber 52 is interrupted, and as the volume of the pump chamber 34 decreases, the pressure of the fuel within the pump chamber 34 is increased. When this fuel pressure exceeds the set pressure, the needle valve 48 of the injection nozzle mechanism 4 is lifted, so that the fuel is injected from the injection ports 45*b***.

As is clear from the foregoing description, the timing of starting the energization of the solenoid coils 65 substantially determines the timing of starting the fuel injection.

When the head **55*b* of the valve member 55 is held in contact with the valve seat 54, the fuel of high pressure is applied from the pump chamber 34 to the annular space 56. However, since the opposed steps or shoulders of the stem portion 55*a* disposed respectively at the opposite ends of the reduced diameter portion 55*c* have the same area, the forces acting respectively on these opposed shoulders in the axial direction of the valve member 55** cancel each other.

During the pump stroke of the plunger 33, when the energization of the solenoid coils 65 are stopped, the valve member 55 is urged downwardly under the influence of the spring 66, so that the head **55*b* is moved away from the valve seat 54. At this moment, the fuel of high pressure within the pump chamber 34 is spilled or fed to the fuel supply and return chamber 52 via the passage 57, the annular space 56 and the space between the valve seat 54 and the head 55*b*. At this time, that is, at an initial stage of the opening movement of the valve member 55, the thus spilled fuel pressure escapes to the atmospheric pressure side, that is, the fuel tank 77, via the valve port 75*a* still in its open condition, the drain passage 75 and the drain pipe 76 with no orifice. Therefore, the increase in pressure of the fuel supply and return chamber 52 is restrained, thereby reducing the force which is exerted on the valve member 55 by the pressure within the fuel supply and return chamber 52 and tends to urge the valve member 55 upward. As a result, the valve member 55 is quickly moved downward, so that the head 55*b* is moved away from the valve seat 54 without delay. This abruptly drops the pressure within the pump chamber 34, so that the injection of the high pressure fuel from the injection port 45*b*** can be stopped at a time.

As described above, since the pressure of the spill fuel can be relieved by means of the drain passage 75 and the drain pipe 76, there is no need to introduce the spill fuel into the armature chamber, as is the case with the fuel injectors of the above-mentioned U.S. patents. More specifically, the armature chamber 64 is isolated from the pump chamber 34, the fuel supply and return chamber 52, etc., and the armature chamber 64 is filled with the air, not with the fuel. Therefore, the armature 61 is not subjected to the flow resistance of the fuel, and the movement of the valve member 55 is not affected, thus ensuring that the valve member 55 has a good response to the energization and de-energization of the solenoid coils 65. As a result, the control of the fuel injection can be carried out easily. In addition, the fuel can be injected at a high injection rate, and the high pressure fuel injection can be stopped at a time.

The fuel, leaking from the fuel supply and return chamber 52 through the slight gap between the inner peripheral surface of the guide hole 51 and the outer peripheral surface of the valve member 55, is arrested by the leakage prevention groove 85. This positively prevents such leakage fuel from intruding into the armature chamber 64.

A leakage hole 90 may be formed in the body 1 as indicated by dots-and-dash lines in FIG. 1, the leakage hole 90 extending generally vertically between the upper and lower surfaces of the body 1 and communicating with the armature chamber 64. The provision of the leakage hole 90 can more positively prevent the fuel from being filled in the armature chamber 64.

Figure 4:
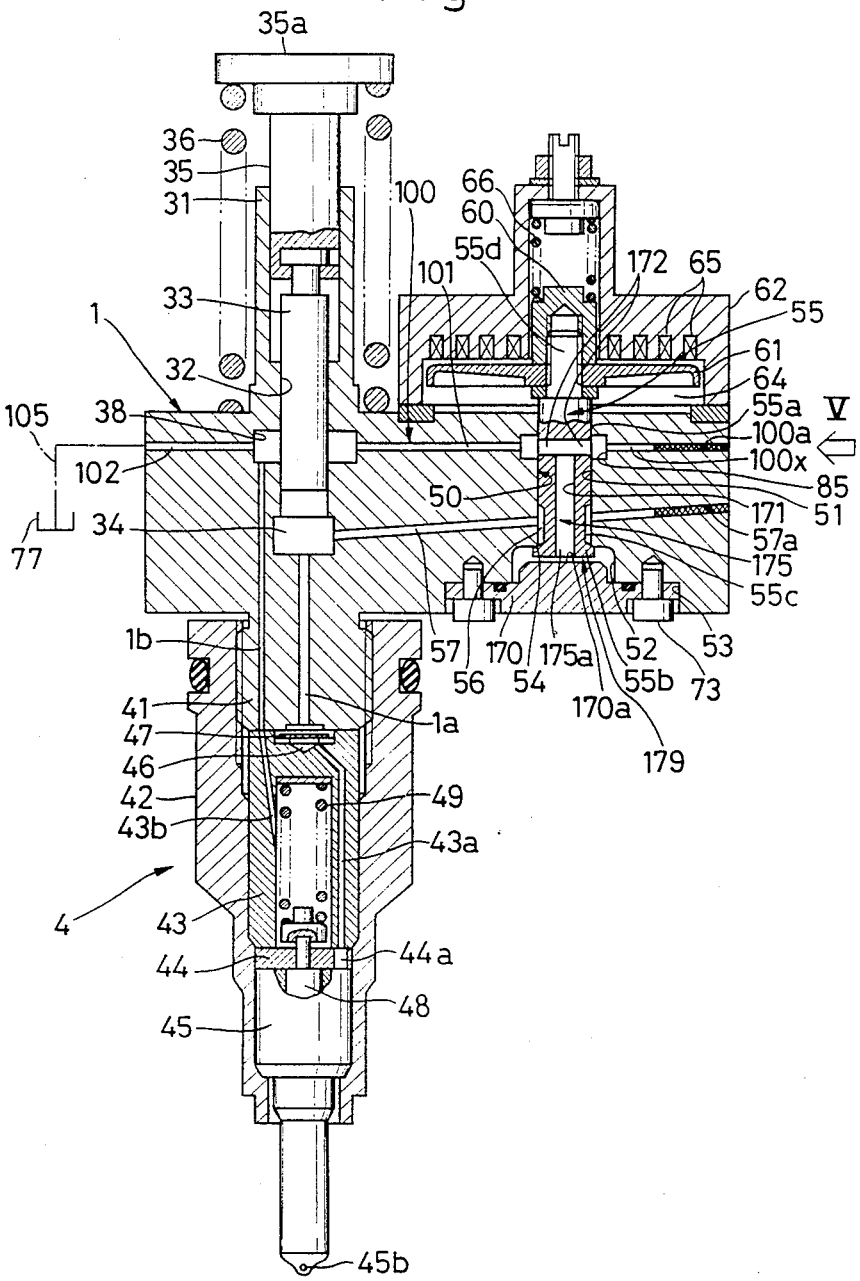
FIG. 4 is a view similar to FIG. 1, but showing a modified unit fuel injector.
Figure 5:
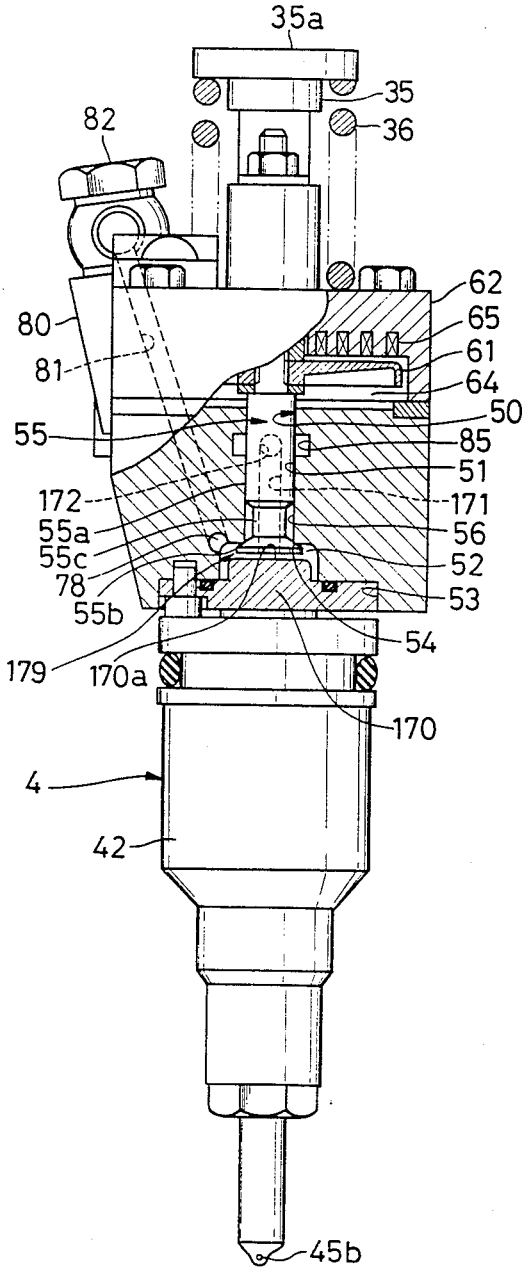
FIG. 5 is a partly cross-sectional, side-elevational view as viewed in a direction of an arrow V of FIG. 4.

FIGS. 4 and 5 shows a modified unit fuel injector according to the present invention. Those parts of this embodiment corresponding to those of the preceding embodiment of FIG. 1 to 3 are denoted by the same reference numerals, respectively, and will not be described in detail here. In this embodiment, as shown in FIG. 4, three horizontal coaxial passages **100*x*, 101 and 102 are formed in the body 1. The right-hand passage 100*x* opens at one end to one end of the body 1, and a closure member 100*a* is fitted in and closes the one end of the passage 100*x*. The intermediate passage 101 communicates the leakage prevention groove 38 in the cylinder hole 32 with the leakage prevention groove 85 in the guide hole 51. The left-hand passage 102 communicates at one end with the leakage prevention groove 38 and opens at the other end to the other end of the body 1. The other end of the passage 102 is connected to the fuel tank 77 through a drain pipe 105. The three passages 100*x*, 101 and 102 and the two leakage prevention grooves 85 and 38 jointly constitute a continuous passage 100 extending between the opposite ends of the body 1**.

In this embodiment illustrated in FIGS. 4 and 5, the lower end of the stepped bore 50 is closed by a lid 170 also serving as a stop member. The lid 170 is not provided with any drain passage. The flat upper surface of the lid 170 serves as a stop surface 170*a*. The valve member 55 has a transverse bore 172 formed transversely through the stem portion 55*a* intermediate the opposite ends of the valve member 55, and an axial bore 171 formed axially in the valve member 55 and extending perpendicularly from the transverse bore 172 to the lower end face of the head 55*b*. The transverse bore 172 opens at its opposite ends into the leakage prevention groove 85. The axial bore 171, the transverse bore 172, the leakage prevention groove 85, the passage 101, the leakage prevention groove 38 and the passage 102 jointly constitute a drain passage 175. One end of the drain passage 175, that is, the lower end of the axial bore 171, serves as a valve port 175*a*. An auxiliary valve mechanism 179 is constituted by the head 55*b* of the valve member 55, the valve port 175*a* and the lid 170. When the lower end face of the head 55*b* is brought into engagement with the stop surface 170*a* of the lid 170, the valve port 175*a* is closed by the stop surface 170*a*. Therefore, the function of the auxiliary valve mechanism 179 is substantially the same as that of the auxiliary valve mechanism 79 of the preceding embodiment of FIGS. 1 to 3. In this embodiment, a portion of the drain passage 175 also serves as a discharge passage for discharging the fuel introduced into the leakage prevention grooves 38 and 85. Therefore, the connection between the unit fuel injector and the fuel tank 77 can be made by only one drain pipe 105.

While the unit fuel injectors according to the present invention have been specifically shown and described herein, the invention itself is not to be restricted to the exact showing of the drawings and the description thereof. For example, the valve member, the solenoid coils, etc., may be contained in a casing, separate from the body, to provide a unit electromagnetic valve mechanism which is designed to be mounted in a mounting hole formed in the body. In this case, the casing of the electromagnetic valve mechanism constitutes a part of the fuel injector body.

Further, the electromagnetic valve mechanism may be so modified that the valve member is urged by the spring toward the valve seat, and that the solenoid, when energized, moves the valve member away from the valve seat.

What is claimed is:

1. A unit fuel injector comprises:

(a) a body having a fuel supply and return chamber, a fuel supply passage means connected to said fuel supply and return chamber so as to supply fuel to said chamber, and a drain passage means connected to said fuel supply and return chamber;

(b) pump means mounted on said body and including a cylinder hole formed in said body, and a plunger received in said cylinder hole so as to be reciprocally movable along said cylinder hole to achieve a pump stroke and a suction stroke, a pump chamber being defined by said cylinder hole and said plunger, and said pump chamber being connected to said fuel supply and return chamber;

(c) nozzle means mounted on said body and including an injection port connected to said pump chamber, and an injection valve for controlling the communication between said injection port and said pump chamber, said injection valve being opened upon increase of the pressure within said pump chamber to a predetermined level;

(d) electromagnetic valve means including a guide hole formed in said body and a valve member guided in said guide hole, said guide hole communicating at one end with said fuel supply and return chamber, a valve seat being formed on a surface defining said one end of said guide hole, said valve member having a stem portion and a head formed at one end of said stem portion, said stem portion having a reduced diameter portion disposed adjacent to said head, said stem portion being slidably received in said guide hole, an annular space being formed between said reduced diameter portion and an inner peripheral surface of said guide hole, said annular space being in communication with said pump chamber, said electromagnetic valve means further including a stop portion facing said fuel supply and return chamber in opposed relation to said valve seat, said head of said valve member being disposed in said fuel supply and return chamber, said valve member being movable between a first position where said head is held against said stop portion and away from said valve seat to communicate said fuel supply and return chamber with said pump chamber via said annular space and a second position where said head is held away from said stop portion and against said valve seat to interrupt the communication between said pump chamber and said fuel supply and return chamber, said electromagnetic valve means further including an armature connected to the other end of said stem portion, a solenoid drive means for driving said armature so as to move said valve member, said valve member being disposed in said first position during said suction stroke so that the fuel is supplied to said pump chamber from said fuel supply and return chamber; when said valve member is moved from said first position to said second position during said pump stroke, the fuel pressure within said pump chamber being increased to thereby start the injection of the fuel from said injection port; and when said valve member is moved from said second position to said first position during said pump stroke, the fuel of high pressure within said pump chamber being spilled to said fuel supply and return chamber to thereby terminate the fuel injection; and (e) auxiliary valve means for opening and closing said drain passage means, said auxiliary valve means comprising said head of said valve member, said stop portion and a valve port provided at one end of said drain passage means, said valve port being closed when said valve member in said first position.

2. A unit fuel injector according to claim 1, in which said stop portion having a bore which constitutes the one end of said drain passage means, said bore of said stop portion opening to that surface of said stop portion facing said head of said valve member, said valve port of said auxiliary valve means being formed in said that surface of said stop portion, and said valve port being closable by said head.

3. A unit fuel injector according to claim 2, in which said body has a stepped bore formed therethrough and having a reduced diameter portion and an enlarged diameter portion, said reduced diameter portion serving as said guide hole, said enlarged diameter portion being closed by a closure means so as to constitute said fuel supply and return chamber, said closure means including said stop portion, said bore of said stop portion extending through said closure means to provide said drain passage means, and one end of said bore of said closure means remote from said valve port being connectable to an atmospheric pressure.

4. A unit fuel injector according to claim 1, in which said drain passage means comprises a first passage formed in said valve member and a second passage formed in said body, said valve port of said auxiliary valve means being formed in an end face of said head of said valve member, said first passage communicating at one end with said valve port, the other end of said first passage opening to the outer peripheral surface of said stem portion of said valve member, said second passage communicating at one end with the other end of said first passage, and the other end of said second passage being connectable to an atmospheric pressure.

5. A unit fuel injector according to claim 4, in which said first passage has a transverse bore formed transversely in said valve member intermediate the opposite ends of said valve member, and an axial bore formed axially in said valve member and extending from said transverse bore to said valve port, one end of said transverse bore remote from said axial bore opening an outer peripheral surface of said stem portion, a leakage prevention groove of an annular shape being formed in an inner peripheral surface of said guide hole, said leakage prevention groove arresting the fuel leaking through a small gap between the inner peripheral surface of said guide hole and the outer peripheral surface of said stem portion, said leakage prevention groove serving as part of said drain passage means, and said first and second passages being connected together by said leakage prevention groove.

6. A unit fuel injector according to claim 5, in which said leakage prevention groove in said guide hole is in communication with another leakage prevention groove formed in an inner peripheral surface of said cylinder hole, said another leakage prevention groove arresting the fuel leaking from said pump chamber through a small gap between the inner peripheral surface of said cylinder hole and the outer peripheral surface of said plunger.

* * * * *